US005342007A

United States Patent [19]

LaPlante

[11] Patent Number: 5,342,007

[45] Date of Patent: Aug. 30, 1994

[54] FRAME FOR POST-SUPPORTED DENTAL EQUIPMENT

[75] Inventor: Pierre M. LaPlante, Newberg, Oreg.

[73] Assignee: A-Dec, Inc., Newberg, Oreg.

[21] Appl. No.: 16,988

[22] Filed: Feb. 11, 1993

[51] Int. Cl.[5] ..... A47F 5/02

[52] U.S. Cl. ..... 248/131; 248/224.3

[58] Field of Search ..... 248/131, 224.3, 220.2; 433/33

[56] References Cited

U.S. PATENT DOCUMENTS

| | | | |
|---|---|---|---|
| 3,129,033 | 4/1964 | Emmerson | 433/33 X |
| 3,245,645 | 4/1966 | Dupler | 248/224.3 X |
| 3,486,728 | 12/1969 | Naughton | 248/429 |
| 3,813,147 | 5/1974 | Rick | 297/191 |
| 3,934,928 | 1/1976 | Johnson | 297/71 |
| 4,114,274 | 9/1978 | Jones | 433/33 |
| 4,141,586 | 2/1979 | Goldner et al. | 297/191 |
| 4,307,475 | 12/1981 | Schmidt | 4/263 |
| 4,410,095 | 10/1983 | Dembicks | 248/220.2 X |
| 4,527,976 | 7/1985 | Behringer et al. | 433/33 |
| 4,655,632 | 4/1987 | Smith | 403/362 |
| 4,878,709 | 11/1989 | Okamoto | 297/68 |
| 4,883,316 | 11/1989 | Austin, Jr. et al. | 297/191 |
| 4,929,023 | 5/1990 | Rasmussen | 297/330 |
| 5,176,423 | 1/1993 | Austin, Jr. et al. | 297/191 |

OTHER PUBLICATIONS

Marus Dental Products three-page instruction manual, circa 1979.

*Primary Examiner*—Ramon O. Ramirez
*Attorney, Agent, or Firm*—Klarquist, Sparkman, Campbell, Leigh & Whinston

[57] ABSTRACT

The frame includes a support plate that has openings fitted with sleeved hubs. The openings and hubs are configured to support dental equipment components that are carried by posts. The frame is constructed so that a given component is readily mounted to any selected one of the openings, thereby providing a variety of user-specified options in equipment arrangement with a single frame configuration.

10 Claims, 2 Drawing Sheets

FRAME FOR POST-SUPPORTED DENTAL EQUIPMENT

TECHNICAL FIELD

This invention relates to a frame to which is mounted post-supported dental equipment, such as lights and instrument control heads used with dental work stations.

BACKGROUND INFORMATION

Most dental work stations are designed to efficiently locate dental equipment in close proximity to the patient, and within easy reach of the dentist and the dental assistant.

The type and specific arrangement of dental equipment used with any given work station will vary, depending on the dentist's particular needs and type of practice.

In many work stations, dental equipment such as lights and mechanical arms for supporting control heads (the control heads holding and controlling handpieces, syringes, etc.) are mounted to posts that serve to support the equipment for limited movement within the work station vicinity.

Prior mounting mechanisms for dental equipment included a central support column attached either directly to the dental chair or to an attachment arm connected to the base of the chair. A frame was fixed to the central support column. The post-supported equipment is mounted to the frame. Prior frames were constructed so that a single post-supported component, such as a mechanical arm for carrying an instrument control head, could be mounted only to a specific, dedicated portion of the frame. The prior frame design, therefore, limited the flexibility with which a dentist could arrange the various components of dental equipment that could be carried by the frame.

SUMMARY OF THE INVENTION

This invention relates to a frame to which post-supported components of dental equipment may be mounted in a variety of arrangements. The frame construction and associated mounting mechanisms provide for flexibility in manufacturing dental work stations so that the dental equipment arrangement specified by the dentist may be readily assembled using a single frame design.

The invention is embodied in a frame that may be carried by an attachment arm that protrudes from the base of a dental chair. The frame has a support plate that has a plurality of openings. A hub is fitted into each of the openings to define passageways for receiving the lower ends of the posts that support dental equipment components. The hubs are fitted with bearings so that the posts are rotatable within the hubs, but the post is stably anchored to the frame. The arrangement of a particular post relative to the frame may be readily altered to accommodate the specific requirements of the dentist.

DESCRIPTION OF THE PREFERRED EMBODIMENTS

Figure 1:
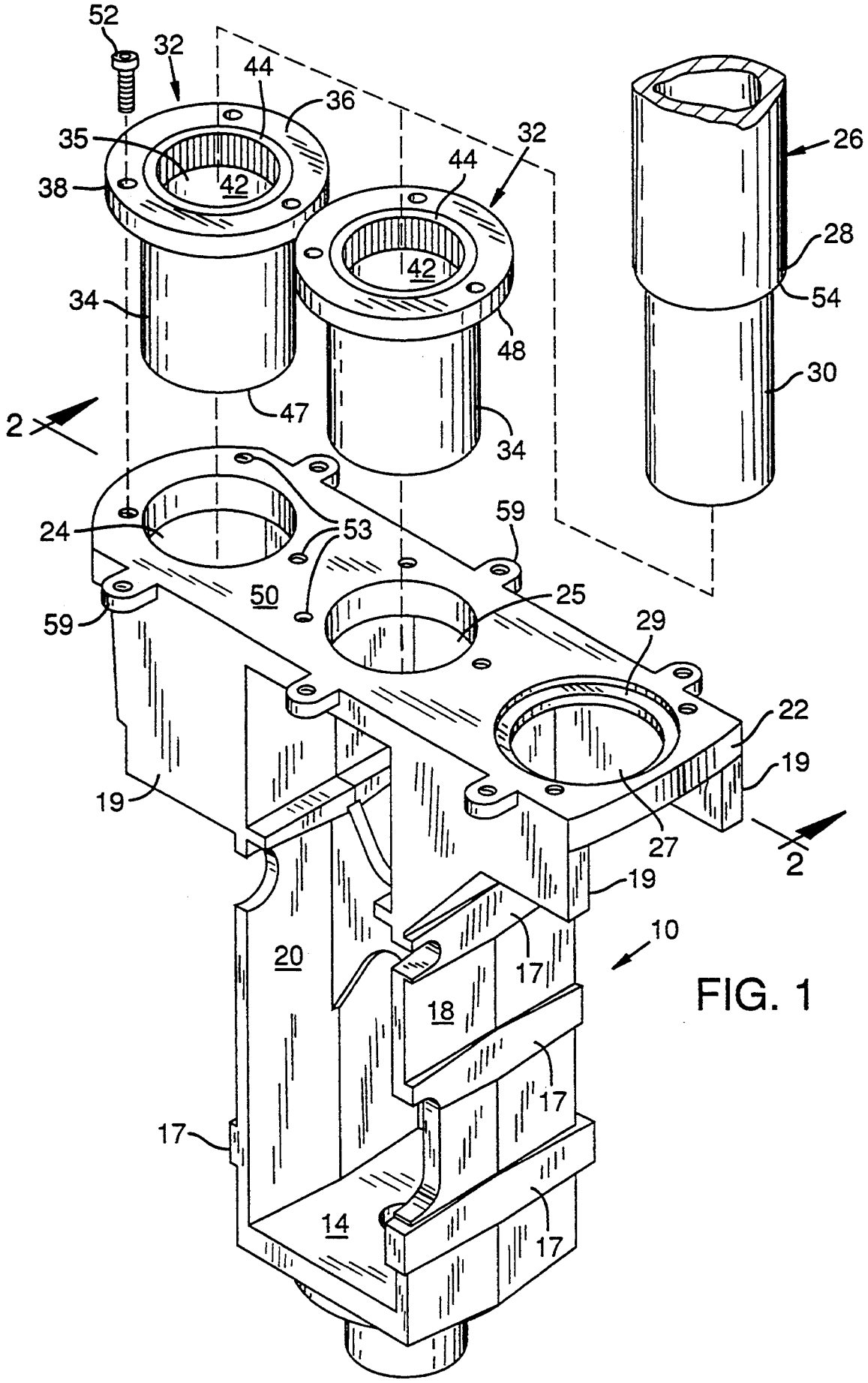
FIG. 1 is a perspective view of one embodiment of the frame of the present invention, showing a post that supports a component of dental equipment.
Figure 2:
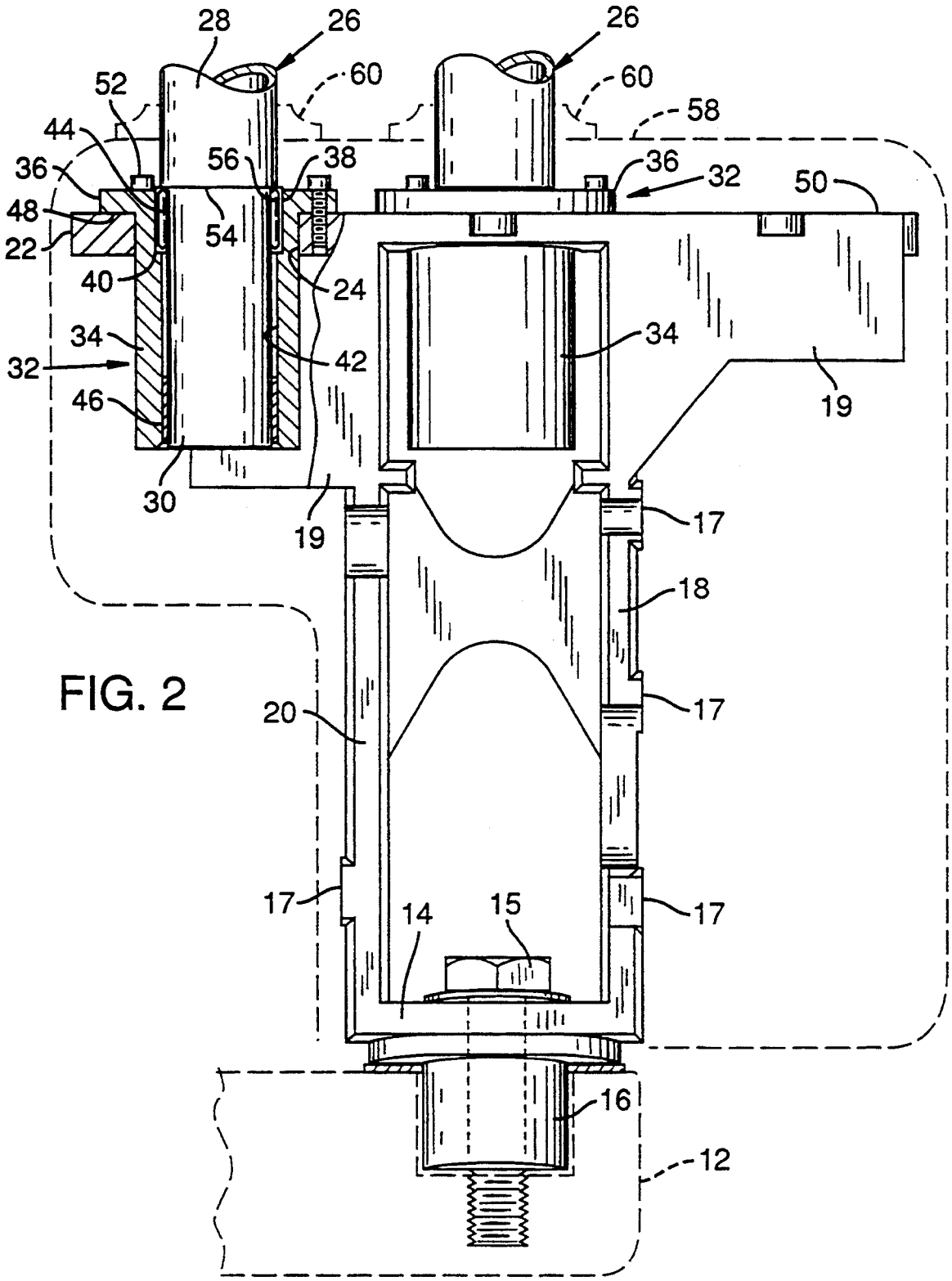
FIG. 2 is a side elevation view of the embodiment of FIG. 1, partly in section.

FIGS. 1 and 2 show one embodiment of a frame 10 formed in accordance with the present invention. As described more fully below, components of dental equipment, such as a cuspidor, light, or mechanical arm for holding a control head, are supported by posts that are mounted to the frame. Frame 10 may be mounted to an attachment arm 12 (dashed lines in FIG. 2). The attachment arm is mounted in a conventional manner to the base of a dental chair (not shown) so that the attachment arm may be rotated from one side of the chair to the other. Because the attachment arm may be rotated from one side of the chair to the other, the equipment components that are mounted to the frame may also be located on either side of the patient.

Frame 10 may be generally described as a T-shaped box. The frame includes a base 14, two parallel, upright supports 18 and 20, and an upper support plate 22 that extends across the upper ends of upright supports 18 and 20. The junction of the upright supports and the support plate 22 is stiffened with gussets 19.

As illustrated in FIG. 2, a downwardly projecting cylinder 16 extends from the bottom side of base 14. Cylinder 16 facilitates attachment of frame 10 to a cylindrical recess in the attachment arm 12. The orientation of the frame 10 relative to attachment arm 12 is fixed when bolt 15, which connects frame 10 to attachment arm 12 is tightened. However, attachment arm 12 may itself be rotated to either side of the dental chair.

Frame 10 is preferably cast in one piece, but may be cast in multiple pieces. For example, upright frame members 18 and 20, and support plate 22 could each be cast separately and bolted or welded together into the configuration of frame 10. The frame is made of aluminum or some other alloy that is relatively lightweight and strong.

A number of flattened regions 17 are provided on the supports 18 and 19 to provide areas to which other pieces of dental equipment may be mounted (for example, with threaded fasteners) to the frame. In instances where the frame is cast, these surfaces are formed without draft, thereby providing a planar surface to which equipment (including mounting brackets and the like) may be secured.

The post-supported equipment that may be mounted to the frame, as described below, may be heavy. Moreover, some equipment, such as lights, may be carried on a long horizontally extending arm, resulting in the creation of a large moment and associated stress at the junction of the support post and frame. The frame 10 is designed to withstand the stresses placed on it, and to stabilize the support posts and equipment against rocking.

A plurality of openings 24, 25, 27 are formed through the support plate 22. The preferred embodiment of frame 10 is shown with three openings 24, 25, 27 in support plate 22. At least two of the smooth-walled openings 24, 25, may be used to anchor a post 26 (hence anchoring the equipment supported by the post 26).

In the preferred embodiment, the end of the post 26 that is mounted to the frame 10 is generally hollow and cylindrical. The electrical, pneumatic, and hydraulic conduits (not shown) that are required for the dental equipment are plumbed through the hollow interior of the post 26. The lowermost end of the post defines a stub 30 having a reduced diameter relative to the immediately adjacent lower end portion 28 of the post. Between the stub 30 and the lower end portion 28 there is defined an annular, flat shoulder 54.

As will become clear upon reading this description, the post 26 may be used for supporting any conventional component of dental equipment, such as a light, a mechanical arm system that carries an instrument control head or any other ancillary dental equipment.

As explained below, a hub 32 is fitted into each of the openings 24, 25 for rotatably receiving the stub 30 of a support post 26. In the embodiment shown in FIGS. 1 and 2, the third hole 27 is formed with a countersunk recess 29 into which fits a thrust bearing (not shown) that may be used in supporting a cuspidor. It is contemplated, however, that hole 27 may be shaped without the counterbored portion and sized as openings 24, 25 to receive a hub 32. Such a configured opening 27, therefore, would be available so that any component of post-supported equipment, including a cuspidor that employs no thrust bearing, may be mounted in any selected combination with other post-supported equipment in any one of the three openings 24, 25, 27.

Each post 26 is mounted to the frame in the same manner, regardless of which opening 24, 25 (or reconfigured opening 27, as just explained) in plate 22 is selected for anchoring a given component. The illustrated embodiment, therefore, shows identical hubs 32 in each opening 24, 25.

Referring to opening 24, the hub 32 is inserted into the opening. Hub 32 includes a cylindrical, elongated, hollow sleeve 34 having a flange 36 at the upper end 38. The sleeve 34 defines an internal passageway 35. An annular groove 40 (FIG. 2) is formed in the interior wall 42 of sleeve 34 at upper end 38 of the sleeve. A conventional roller bearing 44 is fit into groove 40.

An annular sleeve bearing 46, having the same inner diameter as the inner diameter of roller bearing 44, is press fit into the hub sleeve 34 at the lower end 47 of the sleeve. Sleeve bearing 46 is preferably formed of a rigid plastic material but may also be made of other materials suitable for use as bearing surfaces.

Hub 32 is connected to the frame 10 after the roller bearing 44 and sleeve bearing 46 are fit into place in the hub sleeve. Sleeve 34 is inserted downwardly into opening 24 until the underside 48 of flange 36, which flange is larger in diameter than opening 24, rests against the upper surface 50 of plate 22. Hub 32 is bolted into place on plate 22 with bolts 52 that extend into threaded bolt holes 53 in the underlying plate 22.

With hub 32 bolted to frame 10, the stub 30 of a post 26 may be inserted into the hub. The stub 30 fits snugly through the roller bearing 44 and sleeve bearing 46. Stub 30 is, therefore, inserted downwardly into passageway 35 of sleeve 34 until the shoulder 54 of the post 26 rests upon the inner race of roller bearing 44. Stub 30 functions as a bearing surface where it contacts roller bearing 44 and sleeve bearing 46, and post 26 is freely rotatable within the hub 32. Moreover, the depth of insertion of the post 26 within the sleeve 34 is sufficient for developing an adequate reaction moment to any load moment that is generated by the post-supported equipment so that the equipment is stably supported against rocking relative to frame.

As shown in FIGS. 1 and 2, a post 26 and hub 32 mounting mechanism as just described is also employed with the other plate opening 25. Consequently, a particular post-supported component of dental equipment may be mounted to either of the openings 24, 25 in plate 22 in the manner described.

Because any given post-supported component may be attached to any of the openings 24, 25, 27, the frame of the present invention provides great flexibility in the arrangement of post-supported equipment that may be supported by the frame. This flexibility allows the manufacturer to equip and arrange the dental work station according to the user's preference, and without the need for manufacturing a variety of frame configurations.

A housing 58 (shown in dashed lines in FIG. 2) covers the frame 10. Brackets 59 on frame 10 are provided for attaching the housing 58 to the frame. The posts 26 extend through the upper surface of the housing, and a housing collar 60 surrounds the post. The upper surface of the housing through which the posts extend is provided with a number of apertures that correspond to the number of openings formed in the frame support plate 22. The openings in the plate 22 that do not have posts mounted thereto may be covered by caps or plates in the housing surface to close the unused apertures in the housing.

While the present invention has been described in accordance with preferred embodiments, it is to be understood that certain substitutions and alterations may be made thereto without departing from the spirit and scope of the claims.

The invention claimed is:

1. A frame to which may be mounted posts that support dental equipment:

a base;

a plate attached to the base, the plate having two openings; and a hub, configured to fit in one of the openings and attached to the plate to prevent movement of the hub relative to the plate for rotatably supporting relative to the frame an end of a post so that a component of dental equipment supported by the post may be located in either selected one of the two openings.

2. The frame according to claim 1, wherein the openings are formed with smooth walls and wherein the hub fits into the opening, the hub including a flange to facilitate removable attachment of the hub to the plate of the frame.

3. The frame according to claim 1, wherein the hub includes a bearing fitted therein for rotatably supporting the post within the hub.

4. The frame according to claim 3, wherein the hub includes an elongated sleeve portion that defines an elongated passageway within the hub, the post end fitting substantially within the length of the sleeve passageway.

5. The frame according to claim 4, further including a second bearing fitted within the hub for rotatably supporting the post within the hub, the bearings being located in spaced relation, one bearing at each end of the sleeve passageway.

6. A frame for supporting a plurality of post-mounted dental equipment components, comprising:

a base;

two upright frame members;

a plate connected to the upright frame members, the plate having a plurality of sleeved openings that define a plurality of passageways;

at least one post disposed into one of the passageways such that the post is rotatable within the passageway, and bearing surfaces in the passageway contacting the post to support a dental appliance connected to the opposite end of the post; and wherein the opening are configured so that the post may be located in any selected one of the passageways.

7. The frame of claim 6 further comprising a planar surface formed on one of the upright frame members, thereby to provide a planar location to which objects may be mounted.

8. The frame of claim 7 wherein the frame members are cast members and wherein the planar surface is formed without draft.

9. A method of manufacturing a frame to which may be mounted posts that support dental equipment, comprising the steps of:

making a base that has an attached plate, the plate having at least two substantially equal-diameter openings formed therein;

providing a hub to which may be rotatably mounted a post so that the hub is connectable to the frame to fit within any selected one of the openings; and attaching the hub to the plate to prevent movement of the hub relative to the plate so that a post that is rotatably mounted to the hub will be supported in the selected one of the openings.

10. The method of claim 9 including the step of making the openings in the plate with smooth walls.

* * * * *